United States Patent [19]

Grosso

[11] Patent Number: 5,074,593

[45] Date of Patent: Dec. 24, 1991

[54] INSERT HOLDER WITH SEALABLE OPENING

[76] Inventor: John Grosso, 9603 Tresanton Dr., Charlotte, N.C. 28210

[21] Appl. No.: 539,015

[22] Filed: Jun. 15, 1990

Related U.S. Application Data

[63] Continuation-in-part of Ser. No. 445,172, Dec. 4, 1989.

[51] Int. Cl.[5] ..... G09F 1/10

[52] U.S. Cl. ..... 283/77; 283/109; 40/158.1; 40/661

[58] Field of Search ..... 40/158.1, 159, 661; 281/15.1; 283/77, 903, 109, 107

[56] References Cited

U.S. PATENT DOCUMENTS

| | | | |
|---|---|---|---|
| 2,268,529 | 12/1941 | Stiles | 40/158.1 |
| 3,024,553 | 3/1962 | Rowley | 40/158.1 |
| 3,582,439 | 6/1971 | Thomas | 283/77 |
| 3,792,542 | 2/1974 | Cohan | 283/109 |
| 3,855,033 | 12/1974 | Staats | 283/109 |
| 4,183,554 | 1/1980 | Howard, Jr. | 283/109 |
| 4,185,405 | 1/1980 | Giulie | 40/661 |
| 4,330,350 | 5/1982 | Andrews | 283/77 |
| 4,332,095 | 6/1982 | Tanney | 40/158.1 |
| 4,393,989 | 7/1983 | Madin et al. | 40/661 |
| 4,413,434 | 11/1983 | Rupert et al. | 40/661 |
| 4,545,838 | 10/1985 | Minkus et al. | 283/904 |
| 4,575,127 | 3/1986 | Michel | 428/203 |
| 4,589,687 | 5/1986 | Hannon | 283/904 |
| 4,601,489 | 7/1986 | Stancato | 281/15.1 |
| 4,711,347 | 12/1987 | Drexler et al. | 40/159 |
| 4,768,811 | 9/1988 | Oshikoshi et al. | 283/107 |
| 4,825,573 | 5/1989 | Roberts et al. | 40/159 |
| 4,892,335 | 1/1990 | Taft | 283/109 |

*Primary Examiner*—Mark Rosenbaum
*Assistant Examiner*—Hwei-Siu Payer
*Attorney, Agent, or Firm*—W. Thad Adams, III

[57] ABSTRACT

A transparent insert holder of the type characterized by being adapted to receive and protect cards such as photographs, permits and the like. The insert holder includes first and second four-sided plastic sheets for forming front and back sides of the insert holder and a four-sided double-sided adhesive frame for being adhesively positioned between said first and second plastic sheets for securing said first and second sheets together in to form the holder. The adhesive frame defines an opening for receiving a card such as a photograph or identification card therein.

6 Claims, 3 Drawing Sheets

INSERT HOLDER WITH SEALABLE OPENING

TECHNICAL FIELD AND BACKGROUND OF THE INVENTION

This application is a continuation-in-part of application Ser. No. 445,172, filed on Dec. 4, 1989, still pending.

This invention relates to an insert holder of the type used to enclose small photographs, documents such as drivers licenses, identification cards and the like. Many insert holders are known in the prior art. Those of which the applicant is aware can be categorized as follows:

1. a single transparent or translucent plastic sheet which is folded to receive the insert, after which the folded sheet is laminated to seal the three open sides and laminate the sheets to the opposed faces of the insert;

2. two sheets which are sealed on three sides with a permanently open fourth side so that the insert can be inserted and removed repeatedly.

3. two sheets which are sealed on three sides with a open fourth side so that the insert can be inserted. Then the sheet is laminated to laminate the sheets to the opposed faces of the insert;

4. two sheets which are sealed on three sides with a permanently open fourth side so that the insert can be inserted and removed repeatedly. A number of the holders are attached together by the end opposite the open end, and the assembly is used as, for example, in a wallet to hold credit cards, licenses, and the like.

The present invention is directed specifically towards a holder of the type wherein a photograph, license or the like can be permanently enclosed within the holder without the sheets of the holder being laminated to each other or to the faces of the insert. This avoids the requirement of furnishing a laminating machine and permits the holders to be assembled without any machines and without heat. For these reasons, holders can be furnished to consumers for use at home, and mobile sales locations can be set up in stores without requiring a laminator.

SUMMARY OF THE INVENTION

Therefore, it is an object of the invention to provide an insert holder for permanently enclosing a photograph, license or the like.

It is another object of the invention to provide an insert holder which can be permanently sealed after placing an insert within the holder.

It is another object of the invention to provide an insert holder which can be permanently sealed without the use of a laminating machine or other appliance.

These and other objects of the present invention are achieved in the preferred embodiments disclosed below by providing a transparent insert holder of the type characterized by being adapted to receive and protect photographs, permits and the like. The insert holder comprises first and second four-sided plastic sheets for forming front and back sides of the insert holder and a four-sided double-sided adhesive frame for being adhesively positioned between the first and second plastic sheets for securing the first and second sheets together in to form the holder. The adhesive frame defines an opening for receiving a photograph therein.

According to one preferred embodiment of the invention, the first and second plastic sheets are separate and the outer perimeter of the adhesive frame is co-extensive with the perimeter of the first and second plastic sheets.

According to another preferred embodiment of the invention, the adhesive frame comprises a base having first and second pressure sensitive adhesive layers applied to respective sides of the base and first and second protective release liners applied to the respective first and second adhesive layers to protect the adhesive.

According to yet another preferred embodiment of the invention, at least one of the release liners comprises a first, U-shaped segment for being applied co-extensive with three sides of one of the first and second plastic sheets and a second, straight segment for being applied co-extensive with the fourth side of the same one of the first and second plastic sheets.

Preferably, one of the release liners comprises a first, U-shaped segment for being applied co-extensive with three sides of one of the first and second plastic sheets and a second, straight segment for being applied co-extensive with the fourth side of the same one of the first and second plastic sheets; and the other of the release liners comprises a single four-sided frame.

According to one preferred embodiment of the invention, the first sheet includes a side longer than a corresponding side of the second sheet.

According to one preferred embodiment of the invention, the insert holder comprises a four-sided plastic sheet bendable on a fold line to form joined first and second four-sided plastic sheets for defining front and back sides of the insert holder and a four-sided double-sided adhesive frame for being adhesively positioned between the first and second plastic sheets for securing the first and second sheets together to form the holder. The adhesive frame defines an opening for receiving a photograph therein.

According to one preferred embodiment of the invention, portions of at least one of the plastic sheets are opaque and define a transparent portion for displaying a photograph therethrough.

According to another preferred embodiment of the invention, the insert holder includes a four-sided double-sided adhesive frame for being adhesively positioned between the first and second plastic sheets for securing the first and second sheets together to form the holder, the adhesive frame surrounding the transparent portion for receiving a photograph therein.

According to yet another preferred embodiment of the invention, the first sheet and the second sheet each have a slot therein for receiving a holding strap therethrough.

According to one preferred embodiment of the invention, the slots in the first and second sheets are in registration with each other.

According to another preferred embodiment of the invention, the slots in the first and second sheets are out of registration with each other before assembly of the first and second sheets, and wherein the sheets are foldable over each other to place the slots in registration with each other during and after assembly.

An embodiment of the method according to the invention comprises the steps of providing first and second four-sided plastic sheets for forming front and back sides of the insert holder, and providing a four-sided double-sided adhesive frame for being adhesively positioned between the first and second plastic sheets for securing the first and second sheets together in to form the holder, the adhesive frame defining an opening for receiving a photograph therein. The adhesive frame is secured by one of its sides to one of the plastic sheets. A photograph is placed in the opening defined by the adhesive frame and the other plastic sheet is secured to the other side of the adhesive frame to enclose the photograph and form the insert holder.

According to one preferred embodiment of the invention, the method includes the step of securing together the first and second plastic sheets by one side edge before inserting the photograph and securing the remaining three side edges together after the photograph is inserted.

According to another preferred embodiment of the invention, the method includes the steps of providing a four-sided plastic sheet bendable on a fold line to form joined first and second four-sided plastic sheets for defining front and back sides of the insert holder, a four-sided double-sided adhesive frame for being adhesively positioned between the first and second plastic sheets for securing the first and second sheets together to form the holder, the adhesive frame defining an opening for receiving a photograph therein and a four-sided double-sided adhesive frame for being adhesively positioned between the first and second plastic sheets for securing the first and second sheets together in to form the holder. The adhesive frame defines an opening for receiving a photograph therein.

The adhesive frame is secured by one of its sides to one of the plastic sheets and a photograph is placed in the opening defined by the adhesive frame. The other plastic sheet is secured to the other side of the adhesive frame to enclose the photograph and form the insert holder.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
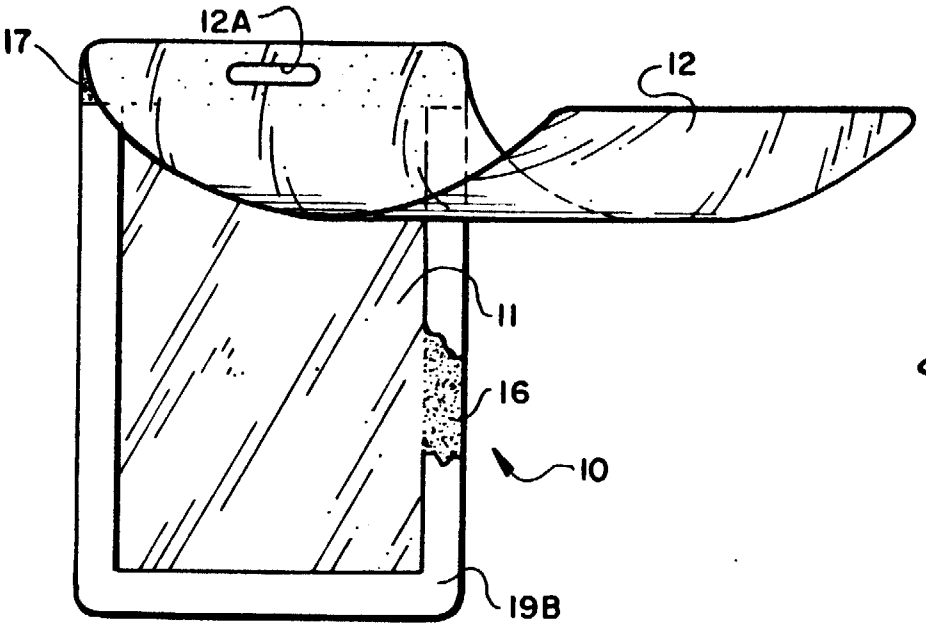
FIG. 1 is a perspective view of an insert holder according to one embodiment in a state of partial assembly.

Referring now specifically to the drawings, an insert holder according to the present invention is illustrated in FIG. 1 and shown generally at reference numeral 10. Holder 10 is formed of a plastic sheet 11, a plastic sheet 12 and an adhesive frame 13. Sheets 11 and 12 and frame 13 all have the same dimensions and are preferably provided with slots 11A, 12A and 13A, respectively, to receive a holding strap after assembly.

The adhesive frame 13 is assembled of a thin plastic or paper substrate sheet 15 having pressure sensitive adhesive layers 16 and 17 applied to opposite sides. Adhesive layers 16 and 17 are protected by release liners 18 and 19 until adhesive frame is used. Release liner 19 is scored to provide individually removable segments 19A and 19B.

Insert holder 10 is assembled by first removing release liner 18 from frame 13. This exposes adhesive layer 16, and the frame 13 is then adhered to plastic sheet 11. Next, release liner segment 19A is removed to expose a strip of the adhesive layer 17 across the top of sheet 11. Sheet 12 is placed in registration over sheet 11 and the top edge of sheet 12 is pressed against the exposed adhesive 17, thereby securing sheets 11 and 12 together across the top edges. This is shown in FIG. 1. At this stage, the remaining assembly may be deferred for as long as desired, usually until the insert is ready to place between the sheets 11 and 12. Note by reference to FIG. 2 that the frame 13 has a thickness which, when applied to sheet 11 forms a template within which a photograph or other card may be placed. By insuring that the insert is no larger than, and preferably on slightly smaller than the open space inside frame 13, the insert can be quickly and accurately placed between the sheets 11 and 12, so that the insert is perfectly aligned with the side edges of the sheets 11 and 12.

Then, the remaining frame segment 19B is peeled away from the adhesive layer 17, and sheet 12 is pressed against adhesive layer 17 around the remaining periphery, sealing the insert permanently inside the holder 10.

Holder 10 may be any suitable size. A preferred embodiment provides a holder which is 2.38 inches wide and 3.5 inches long. Frame segment 19A is 0.375 inches wide. Frame segment 19B is 0.25 inches wide. Slots 11A, 12A, 13A are each 0.13 inches wide and 0.56 inches long.

Sheet 11 is 0.035 inch thick clear plastic. Release liners 18 and 19 are each 0.015 inch thick. Sheet 12, which serves as the display side of the holder 10 is 0.040 inch thick. Frame 13 is preferably opaque to form the appearance of a frame or border when applied as described above.

Figure 5:
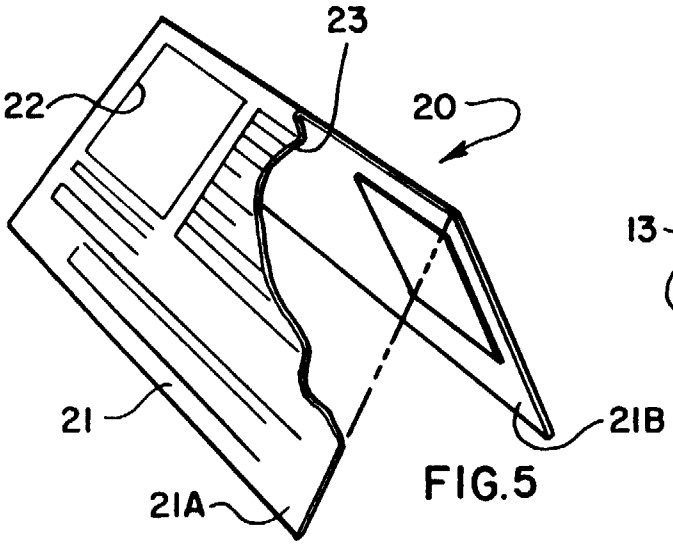
FIG. 5 is a perspective view of the insert holder shown in FIG. 4.
Figure 4:
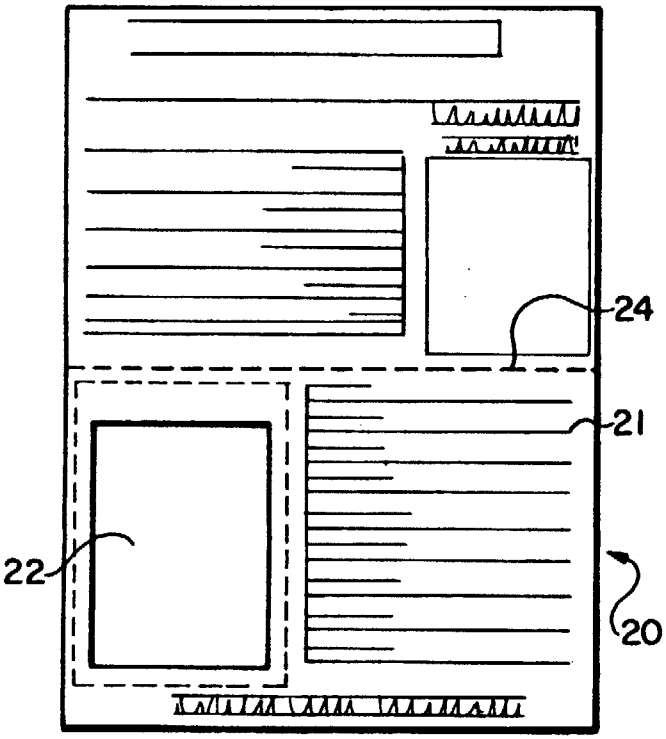
FIG. 4 is a plan view of an insert holder according to another embodiment of the invention.

Referring now to FIGS. 4 and 5, a variation is shown wherein the insert is substantially smaller than the holder, as, for example, in an identification card. Holder 20 comprises a single sheet 21 of clear plastic. The holder 20 is overprinted with blanks, spaces and text material such as would be found on an identification card, leaving a transparent window 22 within which to place an insert such as an identification photograph.

Figure 2:
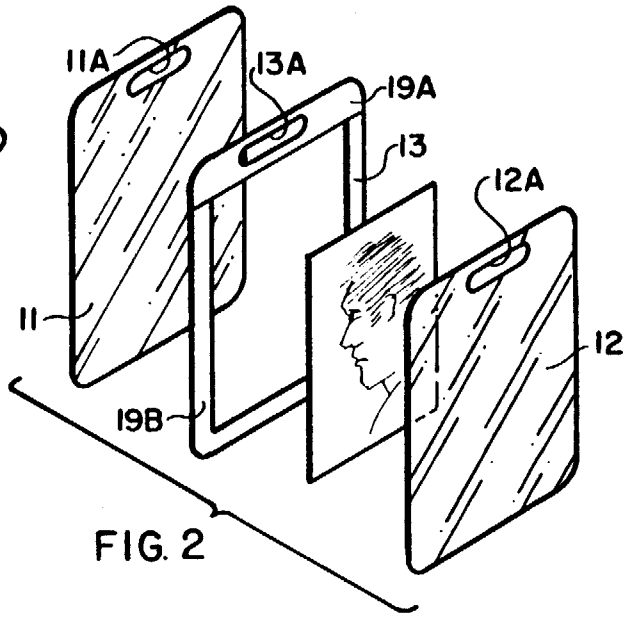
FIG. 2 is an exploded view of the insert holder shown in FIG. 1.
Figure 3:
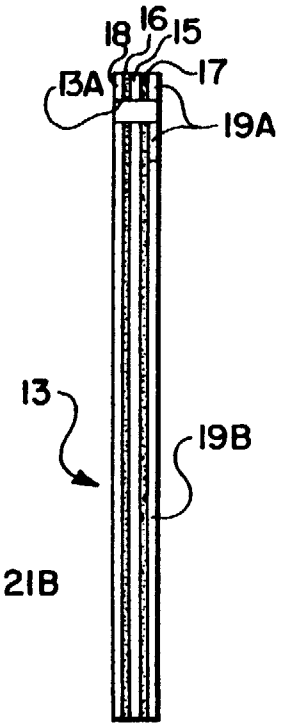
FIG. 3 is a fragmentary cross-section of the adhesive frame shown in FIGS. 1 and 2.

A frame 23 of the same construction as the frame 13 in FIGS. 1, 2 and 3 is adhered to the inside of the sheet 21 around the window 22. Sheet 21 is folded on a fold line 24 as is shown in FIG. 5, to form a front sheet 21A and a back sheet 21B. A photograph is placed behind the window 22. As with holder 10, the frame 13 forms a template having a slight thickness which is sufficient to hold the photograph in its proper position until the assembly of the holder 20 is completed. The entire release liner 19 is removed and the front and back sheets 21A, 21B are pressed together. A seal is created around the photograph which holds it in place. Then, the remainder of the holder can be laminated together in a conventional manner or inserted into a holder such as is shown in FIGS. 6 and 7.

Holder 20 may be any suitable size. According to a preferred embodiment, sheet 21 is 3 inches by 4 inches in its unfolded form. When folded, it forms a double thickness card 3 inches long and 2 inches wide. The sheet 21 is preferably 0.04 inches thick.

Figure 7:
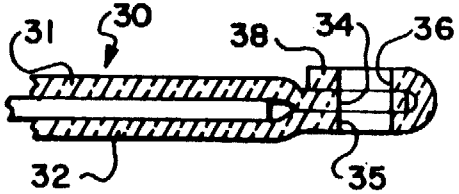
FIG. 7 is a fragmentary cross-sectional view of the insert holder shown in FIG. 6.
Figure 6:
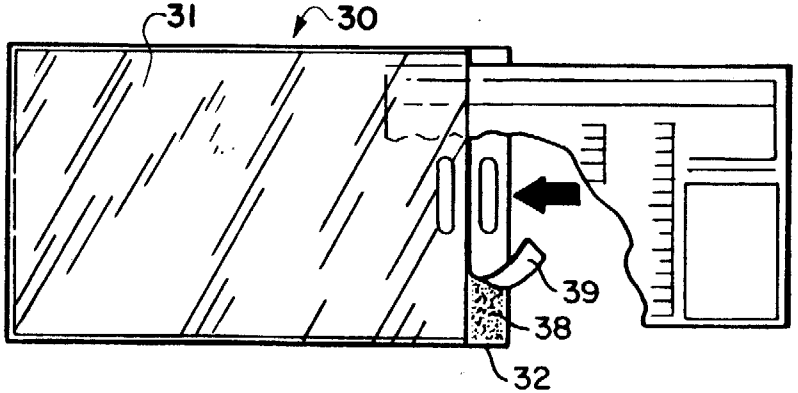
FIG. 6 is a plan view of a means of closing an insert holder.

A closure structure and method is shown in FIGS. 6 and 7. As is best shown in FIG. 7, a holder 30 formed of a front sheet 31 and a back sheet 32, both of clear plastic. Top sheet 31 has a slot 34 near one end. Bottom sheet 32 has two slots—a slot 35 in registration with slot 34 in top sheet 31, and a slot 36 formed in a closure tab 38 which projects outwardly beyond the end of top sheet 31.

Closure tab 38 is coated on one side with a pressure sensitive adhesive and covered with a protective release liner 39. After an insert is placed into the holder 30, the release liner 39 is peeled away, exposing the adhesive. Then, the closure tab 38 is folded over the adjacent side edge of the top sheet 31 and pressed into place. Slot 36 is now in registration with slots 34 and 35. A holding strap may be placed through the aligned slots so that the holder 30 can be secured to luggage or the like.

Figure 8:
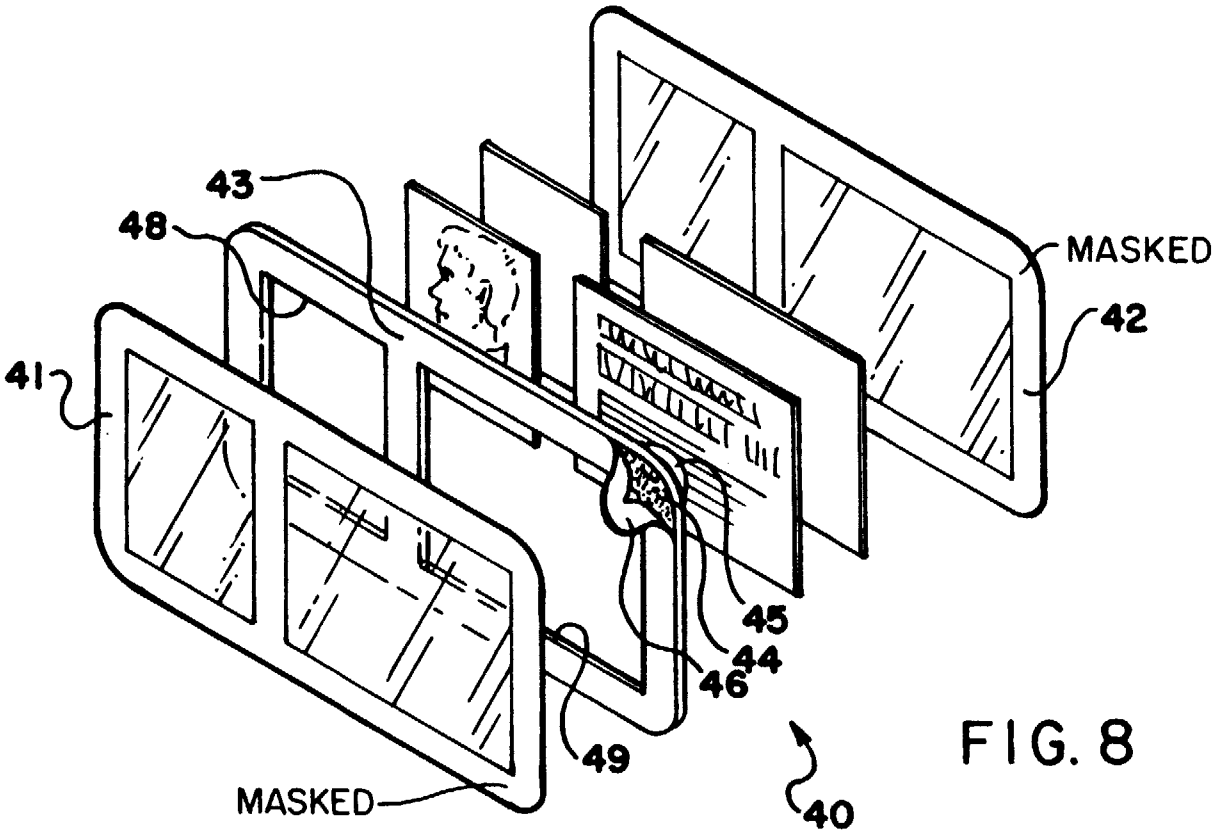
FIG. 8 is a perspective view of a further embodiment of the invention.

A further embodiment of the holder according to the invention is shown in FIG. 8 and broadly indicated at reference numeral 40. Holder 40 is formed of a plastic sheet 41, a plastic sheet 42 and an adhesive frame 43. Sheets 41 and 42 and frame 43 all have substantially the same dimensions and are may be provided with slots (not shown) to receive a holding strap after assembly in the manner described above.

Sheets 41 and 42 are silk-screened or otherwise printed to provide opaque, darkened or decorative border areas leaving centrally-disposed transparent areas to display underlying photographs, identification cards or the like.

The adhesive frame 43 is assembled of a thin plastic or paper substrate sheet 44 having pressure sensitive adhesive layers applied to opposite sides. The adhesive layers are protected by release liners 45 and 46 (shown with corners folded down) until adhesive frame 43 is used. Then the release liners 45 and 46 are peeled off to expose the adhesive.

The frame 43 had two die-cut openings 48, 49 to receive photographs, identification cards or the like.

As is shown in FIG. 8, two photographs or identification cards can be placed back-to-back and then placed in the openings 48, 49. The thickness of the frame 43 is sufficient to hold the inserts in their proper position until the sheets 41 and 42 are adhered to opposite sides of frame 43.

Sheets 41 and 42 may be the same or different thicknesses, for exam 0.01" for front sheet 41 and 0.02" for back sheet 42. This provides proper rigidity to the assembled holder. Frame 43, including the adhesive layers, is preferably 0.016" thick. The dimensions of the sheets 41 and 42 and frame 43 are 3.375" by 2.125". Preferably the openings 48, 49 are very slightly larger in dimension than the transparent areas of sheets 41, 42 to provide a neat finished appearance.

An insert holder according to several embodiments of the invention is described above. Various details of the invention may be changed without departing from its scope. Furthermore the foregoing description of the preferred embodiment of the invention and the best mode for practicing the invention are provided for the purpose of illustration only and not for the purpose of limitation —the invention being defined by the claims.

I claim:

1. An insert holder for receiving, protecting and displaying an object such as a card bearing a photograph comprising:

(a) first and second four-edged plastic cover sheets for forming front and back surfaces of the insert holder, said first plastic cover sheet having a predetermined sized transparent window therein defined by a surrounding non-transparent area;

(b) a four-edges, double-sided frame for being positioned between the first and second plastic sheets for securing said first and second sheets to opposite sides of said frame to form the holder, said frame defining a frame opening therein for receiving a like-sized card therein, the frame opening being larger than the transparent window in the cover sheet to mask the joint line between the card and the frame opening, the thickness of said frame being the same thickness as the card to be inserted in the frame opening whereby the frame forms a support for the card to keep the card in proper alignment while assembly of the holder is completed and the frame and the card inserted in the frame opening together define substantially uniform and flat opposing front and back surfaces;

(c) said frame having front and back surface coated with a pressure sensitive adhesive;

(d) release liner means covering the adhesive to protect the adhesive until assembly of the frame in the cover sheets.

2. An insert holder according to claim 1, wherein said first and second plastic sheets are separate and the outer perimeter of the adhesive frame is substantially co-extensive with the perimeter of said first and second plastic sheets.

3. An insert holder according to claim 1, wherein said release liner means comprises:

a first, U-shaped segment for being applied co-extensive with three sides of one of the first and second plastic sheets; and a second, straight segment for being applied co-extensive with the fourth side of the same one of the first and second plastic sheets.

4. An insert holder according to claim 1, wherein said frame includes first and second openings for receiving respective cards.

5. An insert holder according to claim 1, wherein the surrounding non-transparent area of said first cover is opaque.

6. An insert holder according to claim 1, wherein the surrounding non-transparent area of said first cover is printed to provide an opaque decorative border.

* * * * *